US005332638A

United States Patent [19]

Creatura

[11] Patent Number: 5,332,638

[45] Date of Patent: Jul. 26, 1994

[54] DEVELOPER COMPOSITIONS WITH THERMOSET POLYMER COATED CARRIER PARTICLES

[75] Inventor: John A. Creatura, Ontario, N.Y.

[73] Assignee: Xerox Corporation, Stamford, Conn.

[21] Appl. No.: 39,598

[22] Filed: Mar. 29, 1993

[51] Int. Cl.[5] ..... G03G 9/113

[52] U.S. Cl. ..... 430/108; 430/137

[58] Field of Search ..... 430/108, 137

[56] References Cited

U.S. PATENT DOCUMENTS 3,590,000 6/1971 Palermiti et al. .
3,632,512 1/1972 Miller ..... 430/108 X
3,849,182 11/1974 Hagenbach ..... 430/108
4,233,387 11/1980 Mammino et al. ..... 430/137
4,264,697 4/1981 Perez et al. ..... 430/107
4,397,935 8/1983 Ciccarelli et al. ..... 430/110
4,434,220 2/1984 Abbott et al. ..... 430/108
4,904,762 2/1990 Chang et al. ..... 430/110
5,204,204 4/1993 Shintani et al. ..... 430/108

*Primary Examiner*—Roland Martin
*Attorney, Agent, or Firm*—E. O. Palazzo

[57] ABSTRACT

A carrier composition comprised of a core with a coating thereover comprised of a thermosetting polymer, or mixtures thereof.

20 Claims, No Drawings

DEVELOPER COMPOSITIONS WITH THERMOSET POLYMER COATED CARRIER PARTICLES

BACKGROUND OF THE INVENTION

This invention is generally directed to developer compositions, and more specifically, the present invention relates to developer compositions with coated carrier particles prepared by a dry powder process. In embodiments of the present invention, the carrier particles are comprised of a core with coating thereover comprised of thermosetting resins, or a thermosetting resin, preferably of a low molecular weight, and which coatings may contain internal additives to control the triboelectrical characteristics and conductivity properties thereof. The polymer resins selected as carrier coatings for the present invention can be prepared in extruders below their set temperatures to permit the economical blending of additives therein or thereon, such as charge additives and pigments. In embodiments, the triboelectric and conductivity parameters can be preselected as desired by, for example, the choice of thermoset polymer and additives. Developer compositions comprised of the carrier particles prepared by the dry coating process of the present invention are useful in electrostatographic or electrophotographic imaging systems, especially xerographic imaging processes. Additionally, developer compositions comprised of substantially insulating carrier particles prepared in accordance with the process of the present invention are useful in imaging methods wherein relatively constant conductivity parameters are desired. Furthermore, in the aforementioned imaging processes the triboelectric charge on the carrier particles can be preselected depending on the polymer composition applied to the carrier core. Advantages associated with the present invention include the capability of providing carrier particles with a wide range of triboelectric and conductive characteristics with a single coating; the polymer coating can function as an effective vehicle for toner pigments and other toner components; the polymers are economical and can be easily processed in, for example, melt mixing apparatuses to obtain formulations with preselected properties; subsequent to melt mixing the polymers can be jetted effectively and the particle size reduced to microns for powder coating processes; and the coated carrier products possess extreme durability and toughness primarily because of the crosslinking of the polymers, which crosslinking is accomplished in, for example, a suitable kiln at a temperature of from about 300° to about 500°, and preferably from about 390° to about 400° F.

The electrostatographic process, and particularly the xerographic process, is well known. This process involves the formation of an electrostatic latent image on a photoreceptor, followed by development, and subsequent transfer of the image to a suitable substrate. Numerous different types of xerographic imaging processes are known wherein, for example, insulative developer particles or conductive toner compositions are selected depending on the development systems used. Moreover, of importance with respect to the aforementioned developer compositions is the appropriate triboelectric charging values associated therewith as it is these values that enable continued constant developed images of high quality and excellent resolution.

Additionally, carrier particles for use in the development of electrostatic latent images are described in many patents including, for example, U.S. Pat. No. 3,590,000. These carrier particles may consist of various cores, including steel, with a coating thereover of fluoropolymers; and terpolymers of styrene, methacrylate, and silane compounds. Recent efforts have focused on the attainment of coatings for carrier particles for the purpose of improving development quality; and also to permit particles that can be recycled, and that do not adversely effect the imaging member in any substantial manner. Many of the present commercial coatings can deteriorate rapidly, especially when selected for a continuous xerographic process where the entire coating may separate from the carrier core in the form of chips or flakes, and fail upon impact, or abrasive contact with machine parts and other carrier particles. These flakes or chips, which cannot generally be reclaimed from the developer mixture, have an adverse effect on the triboelectric charging characteristics of the carrier particles thereby providing images with lower resolution in comparison to those compositions wherein the carrier coatings are retained on the surface of the core substrate. Further, another problem encountered with some prior art carrier coatings resides in fluctuating triboelectric charging characteristics, particularly with changes in relative humidity. The aforementioned modification in triboelectric charging characteristics provides developed images of lower quality, and with background deposits.

There is also illustrated in U.S. Pat. No. 4,233,387, the disclosure of which is totally incorporated herein by reference, coated carrier components for electrostatographic developer mixtures comprised of finely divided toner particles clinging to the surface of the carrier particles. Specifically, there is disclosed in this patent coated carrier particles obtained by mixing carrier core particles of an average diameter of from between about 30 microns to about 1,000 microns with from about 0.05 percent to about 3.0 percent by weight, based on the weight of the coated carrier particles, of thermoplastic resin particles. The resulting mixture is then dry blended until the thermoplastic resin particles adhere to the carrier core by mechanical impaction, and/or electrostatic attraction. Thereafter, the mixture is heated to a temperature of from about 320° F. to about 650° F. for a period of 20 minutes to about 120 minutes, enabling the thermoplastic resin particles to melt and fuse on the carrier core. While the developer and carrier particles prepared in accordance with the process of this patent, the disclosure of which has been totally incorporated herein by reference, are suitable for their intended purposes, the conductivity values of the resulting particles are not constant in all instances, for example, when a change in carrier coating weight is accomplished to achieve a modification of the triboelectric charging characteristics; and further with regard to the '387 patent, in many situations carrier and developer mixtures with only specific triboelectric charging values can be generated when certain conductivity values or characteristics are contemplated. With the invention of the present application, the conductivity of the resulting carrier particles are substantially constant, and moreover the triboelectric values can be selected to vary significantly, for example from less than −15 microcoulombs per gram to greater than −70 microcoulombs per gram, depending on the polymer mixture selected for affecting the coating process.

Advantages of the carriers of the present invention over the carriers of the aforementioned dry coated dual polymer carrier coating prior art include in embodiments the use of a single polymer rather than a mixture of polymers, and curing in powdered coating processes and devices, such as a kiln, to enable the formation of crosslinked bonds enabling wear resistant, and low frictional surface polymer coatings.

With further reference to the prior art, carriers obtained by applying insulating resinous coatings to porous metallic carrier cores using solution coating techniques are undesirable from many viewpoints. For example, the coating material will usually reside in the pores of the carrier cores, rather than at the surfaces thereof; and, therefore, is not available for triboelectric charging when the coated carrier particles are mixed with finely divided toner particles. Attempts to resolve this problem by increasing the carrier coating weights, for example, to as much as 3 percent or greater to provide an effective triboelectric coating to the carrier particles necessarily involves handling excessive quantities of solvents, and further usually these processes result in low product yields. Also, solution coated carrier particles, when combined and mixed with finely divided toner particles, provide in some instances triboelectric charging values which are too low for many uses. The powder coating processes overcome these disadvantages, and further enable developer mixtures that are capable of generating high and useful triboelectric charging values with finely divided toner particles; and also wherein the carrier particles are of substantially constant conductivity. Further, when resin coated carrier particles are prepared by the powder coating process of the present invention, the majority of the coating materials are fused to the carrier surface thereby reducing the number of toner impaction sites on the carrier material. Additionally, there can be achieved with the process of the present invention, independent of one another, desirable triboelectric charging characteristics and conductivity values; that is, for example the triboelectric charging parameter is not dependent on the carrier coating weight as is believed to be the situation with the process of U.S. Pat. No. 4,233,387 wherein an increase in coating weight on the carrier particles may function to also permit an increase in the triboelectric charging characteristics. Specifically, therefore, with the carrier compositions and process of the present invention there can be formulated developers with selected triboelectric charging characteristics and/or conductivity values in a number of different combinations.

Thus, for example, there can be formulated in accordance with the invention of the present application developers with conductivities of from about $10^{-6}$ mho $(cm)^{-1}$ to $10^{-17}$ mho $(cm)^{-1}$ as determined in a magnetic brush conducting cell; and triboelectric charging values of from about a $-8$ to a $-80$ microcoulombs per gram on the carrier particles as determined by the known Faraday Cage technique; carrier beads with polyethylene coatings, see column 6; U.S. Pat. Nos. 4,264,697, which discloses dry coating and fusing processes; 3,533,835; 3,658,500; 3,798,167; 3,918,968; 3,922,382; 4,238,558; 4,310,611; 4,397,935 and 4,434,220.

SUMMARY OF THE INVENTION

It is an object of the present invention to provide toner and developer compositions with carrier particles containing a polymer coating.

In another object of the present invention there are provided carrier particles generated by dry coating processes and with substantially constant conductivity parameters.

In yet another object of the present invention there are provided dry coating processes for generating carrier particles of substantially constant conductivity parameters, and a wide range of preselected triboelectric charging values.

In yet a further object of the present invention there are provided carrier particles comprised of a thermosetting polymer, including low molecular weight thermosetting resins that can contain internal additives to enable variation and preselection of triboelectric charge and conductivity.

In still a further object of the present invention there are provided carrier particles comprised of a core with thermosetting polymers, or a thermosetting polymer coating thereover, and which coating may contain additives such as pigments, like carbon black, and charge additives.

In another object of the present invention there are provided methods for the development of electrostatic latent images wherein the developer mixture comprises carrier particles with a thermosetting polymer coating thereover.

Also, in another object of the present invention there are provided positively charged toner compositions, or negatively charged toner compositions having incorporated therein or admixed therewith carrier particles with a coating thereover of a thermosetting polymer, or mixtures thereof, and which polymer is comprised of a low molecular weight component.

These and other objects of the present invention are accomplished by providing developer compositions comprised of toner particles, and carrier particles prepared, for example, by a powder coating process; and wherein the carrier particles are comprised of a core with a thermosetting polymer coating thereover. More specifically, the carrier particles selected can be prepared by mixing low density porous magnetic, or magnetically attractable metal core carrier particles with from, for example, between about 0.05 percent and about 3 percent by weight, based on the weight of the coated carrier particles, of a thermosetting polymer, or mixtures thereof until adherence thereof to the carrier core by mechanical impaction or electrostatic attraction; heating the mixture of carrier core particles and polymer to a temperature, for example, of between from about 300° F. to about 550° F. for an effective period of from, for example, about 10 minutes to about 60 minutes enabling the resulting crosslinked polymers to melt and fuse to the carrier core particles; cooling the coated carrier particles; and, thereafter, classifying the obtained carrier particles to a desired particle size.

In a specific embodiment of the present invention, there are provided carrier particles comprised of a core with a coating thereover comprised of a thermosetting polymer, such as a polyurethane, and which coating may contain additives. Therefore, the aforementioned carrier compositions can be comprised of known core materials including iron with a dry thermosetting polymer coating thereover. Subsequently, developer compositions of the present invention can be generated by admixing the aforementioned carrier particles with a toner composition comprised of resin particles and pigment particles.

Various suitable solid core carrier materials can be selected providing many of the objectives of the present invention are obtained. Characteristic core properties of importance include those that will enable the toner particles to acquire a positive charge or a negative charge, and carrier cores that will permit desirable flow properties in the developer reservoir present in the xerographic imaging apparatus. Also of value with regard to the carrier core properties are, for example, suitable magnetic characteristics that will permit magnetic brush formation in mag brush development processes, and also wherein the carrier cores possess desirable mechanical aging characteristics. Examples of carrier cores that can be selected include iron, steel, ferrites, like copper zinc, copper zinc magnesium, copper zinc aluminum, magnetites, nickel, and mixtures thereof. Preferred carrier cores include ferrites and sponge iron, or steel grit with an average particle size diameter of from between about 100 to 300, and preferably 30 microns to about 200 microns.

Illustrative examples of thermosetting polymer coatings selected for the carrier particles of the present invention include commercially available components, such as polyesters, polyurethanes, epoxies, and polyester hybrids such as a triglycidyl cyanurate. Generally, these polymers are of a low molecular weight ($M_w$), that is from about 20,000 to about 75,000 in embodiments.

The thermoset polymer of a particle diameter of from about 15 to about 40 microns, and preferably from about 20 to about 30 microns is reduced to a particle diameter of from about 1 to about 5 microns in, for example, a 15 inch Sturtevant jet, which size reduction enables in embodiments improved compatibility with the carrier core, especially carrier cores with a diameter of about 80 to about 100, and preferably 90 microns.

There can be included in the carrier coatings in effective amounts of, for example, from about 1 to about 20 weight percent, and preferably from about 1 to about 5 weight percent, carbon blacks like REGAL 330®, BLACK PEARLS L TM and the like; charge additives such as alkylpyridinium halides; bisulfates; distearyl dimethyl ammonium methyl sulfate, and other known charge additives as well as mixtures thereof, reference for example U.S. Pat. No. 4,904,762 and the patents recited therein, the disclosures of which are totally incorporated herein by reference; metal powders like magnetites, iron, aluminum, titanium, and the oxides and dioxides thereof.

Examples of characteristics associated with the carrier particles of the present invention include a tribo sign of positive or negative, for example, from a −50 to a positive 50 microcoulombs per gram and preferably from a −20 to a positive 20 microcoulombs per gram; a preselected range of carrier conductivities, such as $10^{-17}$ to about $10^{-1}$ mho $cm^{-1}$, and, more specifically, from about $10^{-15}$ to about $10^{-6}$ mho $cm^{-1}$; and the conductivity of the coating thermoset polymer can provide carrier particles with a desired preselected conductivity. The carrier coatings are durable and substantially wear resistant, and the like as indicated herein.

Various effective suitable means can be used to apply the thermosetting polymer, or mixtures thereof to the surface of the carrier particles. Examples of typical means for this purpose include combining the carrier core material, and the thermoset polymer by cascade roll mixing, or tumbling, milling, shaking, electrostatic powder cloud spraying, fluidized bed, electrostatic disc processing, and an electrostatic curtain. Following application of the polymer, heating is initiated to permit flowout of the coating material over the entire surface of the carrier core. The concentration of the coating material powder particles, as well as the parameters of the heating step, may be selected to enable the formation of a continuous film of the coating material on the surface of the carrier core, or permit only selected areas of the carrier core to be coated. When selected areas of the metal carrier core remain uncoated or exposed, the carrier particles will possess electrically conductive properties when the core material comprises a metal. The aforementioned conductivities can include various suitable values. Generally, however, this conductivity is from about $10^{-9}$ to about $10^{-17}$ mho-$cm^{-1}$ as measured, for example, across a 0.1 inch magnetic brush at an applied potential of 10 volts; and wherein the coating coverage encompasses from about 10 percent to about 100 percent of the carrier core.

Illustrative examples of finely divided toner resins selected for the developer compositions of the present invention include polyamides, epoxies, polyurethanes, diolefins, vinyl resins and polymeric esterification products of a dicarboxylic acid and a diol comprising a diphenol, and generally styrene acrylates, styrene methacrylates, styrene butadienes, polyesters, and mixtures thereof. Specific vinyl monomers that can be used are styrene, p-chlorostyrene vinyl naphthalene, unsaturated mono-olefins such as ethylene, propylene, butylene and isobutylene; vinyl halides such as vinyl chloride, vinyl bromide, vinyl fluoride, vinyl acetate, vinyl propionate, vinyl benzoate, and vinyl butyrate; vinyl esters like the esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalphachloracrylate, methyl methacrylate, ethyl methacrylate, and butyl methacrylate; acrylonitrile, methacrylonitrile, acrylamide, vinyl ethers, inclusive of vinyl methyl ether, vinyl isobutyl ether, and vinyl ethyl ether, vinyl ketones inclusive of vinyl methyl ketone, vinyl hexyl ketone and methyl isopropenyl ketone; vinylidene halides, extruded polyesters, reference U.S. Ser. No. 814,641 and U.S. Ser. No. 814,782, the disclosures of which are totally incorporated herein by reference, and the like.

As one toner resin, there can be selected the esterification products of a dicarboxylic acid and a diol comprising a diphenol, reference U.S. Pat. No. 3,590,000, the disclosure of which is totally incorporated herein by reference. Other toner resins include styrene/methacrylate copolymers; styrene/butadiene copolymers; polyester resins obtained from the reaction of bisphenol A and propylene oxide; and branched polyester resins resulting from the reaction of dimethylterephthalate, 1,3-butanediol, 1,2-propanediol and pentaerythritol.

Generally, from about 1 part to about 5 parts by weight of toner particles are mixed with from about 10 to about 300 parts by weight of the carrier particles prepared in accordance with the process of the present invention.

Numerous well known suitable pigments or dyes can be selected as the colorant for the toner particles including, for example, carbon black like REGAL 330®, nigrosine dye, lamp black, iron oxides, magnetites, and mixtures thereof. The pigment, which is preferably carbon black, should be present in a sufficient amount to render the toner composition highly colored. Thus, the pigment particles are present in amounts of from about 3 percent by weight to about 20 percent by weight, based on the total weight of the toner composition, however, lesser or greater amounts of pigment particles can be selected providing the objectives of the present invention are achieved.

When the pigment particles are comprised of magnetites, which are a mixture of iron oxides ($FeO.Fe_2O_3$), including those commercially available as MAPICO BLACK TM, they are present in the toner composition in an amount of from about 10 percent by weight to about 70 percent by weight, and preferably in an amount of from about 20 percent by weight to about 50 percent by weight.

The resin particles are present in a sufficient, but effective amount, thus when 10 percent by weight of pigment or colorant, such as carbon black, is contained therein, about 90 percent by weight of resin material is selected. Generally, however, providing the objectives of the present invention are achieved, the toner composition is comprised of from about 85 percent to about 97 percent by weight of toner resin particles, and from about 3 percent by weight to about 15 percent by weight of pigment particles such as carbon black.

Also included within the scope of the present invention are colored toner compositions comprised of toner resin particles, carrier particles and as pigments or colorants, magenta, cyan and/or yellow particles as well as mixtures thereof. More specifically, illustrative examples of magenta materials that may be selected as pigments include 1,9-dimethyl-substituted quinacridone and anthraquinone dye identified in the Color Index as Cl 60720, Cl Dispersed Red 15, a diazo dye identified in the Color Index as CI 26050, CI Solvent Red 19, and the like. Examples of cyan materials that may be used as pigments include copper tetra-4-(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, permanent yellow FGL, and the like. These pigments are generally present in the toner composition in an amount of from about 1 weight percent to about 15 weight percent based on the weight of the toner resin particles.

For further enhancing the positive charging characteristics of the developer compositions described herein, and as optional components there can be incorporated herein charge enhancing additives inclusive of alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; and other similar known charge enhancing additives. These additives are usually incorporated into the toner in an amount of from about 0.1 percent by weight to about 20, and preferably about 3 percent by weight.

The toner composition of the present invention can be prepared by a number of known methods, including melt blending the toner resin particles, and pigment particles or colorants of the present invention, followed by mechanical attrition. Other methods include those well known in the art such as spray drying, melt dispersion, dispersion polymerization and suspension polymerization. In one dispersion polymerization method, a solvent dispersion of the resin particles and the pigment particles are spray dried under controlled conditions to result in the desired product. The toners can be classified to enable compositions with an average volume particle diameter of from about 5 to about 20 microns.

The toner and developer compositions of the present invention may be selected for use in electrostatographic imaging processes containing therein conventional photoreceptors, including inorganic and organic photoreceptor imaging members. Examples of imaging members are selenium, selenium alloys, and selenium or selenium alloys containing therein additives or dopants such as halogens. Furthermore, there may be selected organic photoreceptors, illustrative examples of which include layered photoresponsive devices comprised of transport layers and photogenerating layers, reference U.S. Pat. No. 4,265,990, the disclosure of which is totally incorporated herein by reference, and other similar layered photoresponsive devices. One imaging member can be comprised of an aluminum substrate, a photogenerating layer of trigonal selenium dispersed in polyvinyl carbazole thereover, and a charge transport layer of N,N'-diphenyl-N,N'-bis(3-methylphenyl)[1,1-biphenyl]-4,4'-diamine, 50 percent by weight dispersed in 50 percent by weight of polycarbonate. Moreover, the developer compositions of the present invention are particularly useful in electrostatographic imaging processes and apparatuses wherein there is selected a moving transporting means and a moving charging means; and wherein there is selected a deflected flexible layered imaging member, reference U.S. Pat. Nos. 4,394,429 and 4,368,970, the disclosures of which are totally incorporated herein by reference.

Images obtained with this developer composition had acceptable solids, excellent halftones and desirable line resolution with acceptable or substantially no background deposits.

With further reference to the process for generating the carrier particles illustrated herein, there is initially obtained, usually from commercial sources, the uncoated carrier core and the thermosetting polymer powder coating. The blending can be accomplished by numerous known methods including, for example, a twin shell mixing apparatus. Thereafter, the carrier core polymer is incorporated into a mixing apparatus, about 1 percent by weight of the powder to the core by weight in a preferred embodiment, and mixing is affected for a sufficient period of time until the polymer is uniformly distributed over the carrier core, and mechanically or electrostatically attached thereto. Subsequently, the resulting coated carrier particles are metered into a rotating tube furnace, which is maintained at a sufficient temperature to cause melting and fusing of the thermoset polymer to the carrier core.

The following Examples are being supplied to further define the present invention, it being noted that these Examples are intended to illustrate and not limit the scope of the present invention. Parts and percentages are by weight unless otherwise indicated.

EXAMPLE I

There were prepared carrier particles by coating 68,040 grams of an atomized iron core powder, 90 microns in diameter, with 272 grams of a polyurethane, UFC-400-59 TM, resin obtained from O'Brien Chemicals, and which resin had an average particle diameter of from about 20 to 30 microns. The aforementioned polyurethane particles were reduced in size from about 20 to about 30 microns to from about 1 to about 5 microns in diameter, which size reduction was accomplished in a 15 inch Sturtevant jet. Subsequently, the carrier core and resin were mixed in a Munsen Mixer for about 35 minutes, and fused in a kiln at a temperature of 400° F., whereby the polyurethane adheres to the steel core, and the continuous coating weight was 0.4 weight percent.

A developer composition was then prepared by mixing 97.5 grams of the above prepared carrier particles with 2.5 grams of a toner composition comprised of 92 percent by weight of a styrene n-butylmethacrylate copolymer resin, 58 percent by weight of styrene, 42 percent by weight of n-butylmethacrylate; 10 percent by weight of carbon black; and 2 percent by weight of the charge additive cetyl pyridinium chloride. Thereafter, the triboelectric charge on the carrier particles was determined by the known Faraday Cage process, and there was measured on the carrier a charge of a positive 20 microcoulombs per gram. Further, the conductivity of the carrier as determined by forming a 0.1 inch long magnetic brush of the carrier particles, and measuring the conductivity by imposing a 10 volt potential across the brush, was $10^{-14}$ mho-cm$^{-1}$.

In all the working Examples, the triboelectric charging values and the conductivity numbers were obtained in accordance with the aforementioned procedure.

EXAMPLE II

The procedure of Example I was repeated with the additions that 0.5 percent by weight of LITHOL SCARLET RED TM was dry blended with the polyurethane and the product mixture was extruded in a Werner Pfleiderer Extruder ZSK-28 at 290° F., followed by reducing the polymer resin particle size in a 15 inch Sturtevant Jet to 1 to 5 microns as measured with a Coulter Counter. There resulted on the carrier particles a triboelectric charge of a positive 7 microcoulombs per gram. Also, the carrier particles had a conductivity of $10^{-14}$ mho-cm$^{-1}$. This carrier is believed to be particularly useful in xerographic inductive magnetic brush (IMB) development.

EXAMPLE III

A developer composition of the present invention was prepared by repeating the procedure of Example II with the exception that there was selected in place of the LITHOL SCARLET TM the charge additive distearyl dimethyl ammonium methyl sulfate (DDAMS). There resulted on the carrier particles a triboelectric charge of a positive 2 microcoulombs per gram. Also, the carrier particles were insulating in that they had a conductivity of $10^{-14}$ mho-cm$^{-1}$. This insulating carrier is believed to be particularly useful in xerographic inductive magnetic brush (IMB) development.

EXAMPLE IV

A developer composition was prepared by repeating the procedure of Example I with the exception that there was added 5 percent by weight of the charge additive TRH, believed to be an aluminum complex, reference U.S. Pat. No. 4,845,003, the disclosure of which is totally incorporated herein by reference, and obtained from Hodogaya Chemicals of Japan, to the polyurethane, which charge additive was distributed evenly throughout the carrier polymer coating resin. There resulted on the carrier particles a triboelectric charge of a positive 50 microcoulombs per gram, and the carrier particles had a conductivity of $10^{-14}$ mho-cm$^{-1}$.

EXAMPLE V

A developer composition was prepared by repeating the procedure of Example IV with the exception that there was added 5 weight percent of tin oxide, which oxide was distributed evenly throughout the carrier thermosetting polymer coating resin. There resulted on the carrier particles a triboelectric charge of 50 microcoulombs per gram, and the carrier particles had a conductivity of $10^{-14}$ mho-cm$^{-1}$.

EXAMPLE VI

A developer composition was prepared by repeating the procedure of Example IV with the exception that there was added 15 weight percent of REGAL 330® carbon black distributed evenly throughout the carrier polymer coating resin. There resulted on the carrier particles a triboelectric charge of 15 microcoulombs per gram, and the carrier particles had a conductivity of $10^{-8}$ mho-cm$^{-1}$.

EXAMPLE VII

A developer composition was prepared by repeating the procedure of Example VI with the exception that there was added 20 weight percent of REGAL 330® carbon black. There resulted on the carrier particles a triboelectric charge of 20 microcoulombs per gram, and the carrier particles had a conductivity of $10^{-7}$ mho-cm$^{-1}$. This conductive carrier is believed to be particularly suitable for xerographic conductive magnetic brush development (CMB).

EXAMPLE VIII

A developer composition was prepared by repeating the procedure of Example VI with the exception that there was added to the polymer coating 20 weight percent of REGAL 330® carbon black and 5 percent of DDAMS. There resulted on the carrier particles a triboelectric charge of 3 microcoulombs per gram, and the carrier particles had a conductivity of $10^{-7}$ mho-cm$^{-1}$.

EXAMPLE IX

A developer composition was prepared by repeating the procedure of Example I with the exception that there was selected in place of the polyurethane a polyester PFC-400 obtained from O'Brien Chemicals and dry blending was accomplished with 100 micron irregular shaped water atomized iron powder at a coating weight of 0.1 weight percent; and 68,040 grams of carrier core and 68 grams of polyester were selected. There resulted on the carrier particles a triboelectric charge of 27.1 microcoulombs per gram, and the carrier particles had a conductivity of $10^{-8}$ mho-cm$^{-1}$.

EXAMPLE X

A developer composition was prepared by repeating the procedure of Example IX, and dry blending was accomplished with 125 micron irregular shaped water atomized iron powder. There resulted on the carrier particles a triboelectric charge of 23.6 microcoulombs per gram, and the carrier particles had a conductivity of $10^{-8}$ mho-cm$^{-1}$.

EXAMPLE XI

A developer composition was prepared by repeating the procedure of Example IX with the exception that there were selected 100 micron smooth spherical shaped water atomized iron powder; the coating resin weight was 0.3 percent; and 68,040 grams of carrier core and 204 grams of polyester were selected. There resulted on the carrier particles a triboelectric charge of 18.7 microcoulombs per gram, and the carrier particles had a conductivity of $10^{-8}$ mho-cm$^{-1}$.

With embodiments of the present invention, the particle size of the thermoset polymer resins is preferably reduced from 20 to 30 microns to 1 to 5 microns by a number of known means, such as in a Sturtevant jetting device. This reduction enables, for example, excellent compatibility with the carrier core particles, permits effective economical coating of the carrier core, and the like.

Other modifications of the present invention may occur to those skilled in the art based upon a reading of the present disclosure, and these modifications are intended to be included within the scope of the present invention.

What is claimed is:

1. A carrier composition consisting essentially of a core with a coating thereover comprised of a thermoset polymer, and which coating contains a charge control component thereby enabling the triboelectric charge on the carrier particles to be preselected and wherein the conductivity thereof is from about $10^{-6}$ to about $10^{-17}$ (mho-cm)$^{-1}$.

2. A carrier composition consisting of a core with a coating thereover comprised of a thermoset polymer, contains a charge control component said coating or mixtures or mixtures thereof, which additives are present in an amount of about 0.1 to about 10 weight percent, and wherein there is enabled a carrier with a conductivity of from about $10^{-6}$ to about $10^{-17}$ (mho-cm)$^{-1}$, and with a triboelectric charge of from about −50 to about a positive 50 microcoulombs per gram.

3. A carrier composition in accordance with claim 2 wherein the core is selected from the group consisting of iron, ferrites, steel and nickel.

4. A carrier composition in accordance with claim 2 wherein the thermoset polymer is a polyurethane, an epoxy, a polyester, or an epoxy-polyester.

5. A carrier composition in accordance with claim 2 wherein the polymer coating weight is from about 0.1 to about 5 weight percent.

6. A carrier composition in accordance with claim 2 wherein the diameter of the carrier particles is from about 100 microns to about 300 microns.

7. A carrier composition in accordance with claim 1 wherein said charge control component is alkyl pyridinium halides, distearyl dimethyl ammonium methyl sulfate, or TRH.

8. A carrier composition in accordance with claim 1 wherein the additives are present in an amount of from about 0.1 to about 10 weight percent.

9. A carrier composition in accordance with claim 2 with a conductivity of from about $10^{-6}$ to about $10^{-15}$ mho-cm$^{-1}$.

10. A carrier composition in accordance with claim 2 with a tribo of from about a −20 to a +20 microcoulombs per gram.

11. A developer composition comprised of the carrier particles of claim 1 and a toner composition comprised of toner resin particles and pigment particles.

12. A developer composition in accordance with claim 11 wherein the toner resin is comprised of styrene polymers.

13. A developer composition in accordance with claim 11 wherein the styrene polymers are selected from the group consisting of styrene methacrylates and styrene acrylates.

14. A developer composition in accordance with claim 11 wherein the toner resin is selected from the group consisting of polyesters and styrene butadienes.

15. A developer composition in accordance with claim 11 wherein the pigment particles are carbon black.

16. A developer composition in accordance with claim 11 wherein the toner contains therein charge enhancing additives.

17. A developer composition in accordance with claim 11 wherein the charge enhancing additive is selected from the group consisting of alkyl pyridinium halides, organic sulfate and sulfonate compositions, and distearyl dimethyl ammonium methyl sulfate.

18. A carrier composition comprised of a core with a coating thereover comprised of a thermoset polymer, the improvement residing in including in the thermoset polymer a charge additive thereby enabling a carrier with a conductivity of from about $10^{-15}$ to about $10^{-6}$ (mho-cm)$^{-1}$ and a triboelectric charge of from about a minus 20 to about a positive 20 microcoulombs per gram.

19. A carrier in accordance with claim 18 wherein and the charge enhancing additive is distearyl dimethyl ammonium methyl sulfate.

20. A carrier composition consisting of a core with a coating thereover comprised of a thermoset polymer, or mixtures thereof; and wherein said coating or mixtures thereof contains therein charge control additive components which components are present in an amount of about 0.1 to about 10 weight percent, and wherein there is enabled a carrier with a conductivity of from about $10^{-6}$ to about $10^{-17}$ (mho-cm)$^{-1}$, and with a triboelectric charge of from about −50 to about a positive 50 microcoulombs per gram; and wherein said carrier particles are prepared by (1) mixing a carrier core with a thermosetting polymer, and included in said thermosetting polymer said charge enhancing additive component; (2) dry mixing the carrier core particles and the polymer for a sufficient period of time enabling the polymer to adhere to the carrier core containing said charge enhancing additive; (3) heating the resulting mixture of carrier core and polymer to a temperature of between about 300° F. and about 550° F., whereby the polymer melts, crosslinks and fuses to the carrier core; and (4) thereafter cooling the resulting coated carrier particles.

* * * * *